US011705093B1

(12) United States Patent
Burch

(10) Patent No.: US 11,705,093 B1
(45) Date of Patent: Jul. 18, 2023

(54) FLIP TUNING LEVERS DEVICE

(71) Applicant: Eric E. Burch, Winter Park, FL (US)

(72) Inventor: Eric E. Burch, Winter Park, FL (US)

( * ) Notice: Subject to any disclaimer, the term of this patent is extended or adjusted under 35 U.S.C. 154(b) by 0 days.

(21) Appl. No.: 17/751,529

(22) Filed: May 23, 2022

(51) Int. Cl.
*G10D 3/14* (2020.01)

(52) U.S. Cl.
CPC ..... *G10D 3/14* (2013.01)

(58) Field of Classification Search
CPC ..... G10D 3/14; G10D 3/00
See application file for complete search history.

(56) References Cited

U.S. PATENT DOCUMENTS

2023/0057797 A1* 2/2023 Cohen ..... G10D 3/153

* cited by examiner

*Primary Examiner* — Kimberly R Lockett
(74) *Attorney, Agent, or Firm* — Cramer Patent & Design, PLLC; Aaron R. Cramer

(57) ABSTRACT

A flip tuning levers device that does not put added stress on a plurality of guitar strings to get them out of tune. The flip tuning levers device includes a plurality of levers, a plurality of vertical shafts, a plurality of shims, a horizontal shaft, and a base plate. The levers each include a handle, a rotating pin joint, and an upside-down cylindrical-shaped indentation. The base plate includes a plurality of apertures that include a first set of apertures that accommodate receiving a plurality of fasteners and a second set of apertures that accommodate receiving the distal ends of each of the vertical shafts, the first set of apertures correspond with a plurality of preexisting holes disposed on a headstock of the guitar. The flip tuning levers device is made from a three-dimensional printer for accuracy and cost-reduction or is made of titanium for strength and ease of fabrication.

20 Claims, 4 Drawing Sheets

FLIP TUNING LEVERS DEVICE

RELATED APPLICATIONS

None.

FIELD OF THE INVENTION

The present invention is a tuning device for a guitar. More specifically, the present invention is a flip tuning levers device.

BACKGROUND OF THE INVENTION

Currently there are screw-related devices that lock the tuning of a guitar. If a guitar player is utilizing one of these screw-related devices, the guitar player is left with a serious problem if one of the screws from these screw-related devices strip or is damaged. At that point, the guitar will not lock in tune and the damaged screw from the screw-related devices will need to either be rethreaded or replaced. A guitar tuning device that does not utilize screws that may strip is more desirable.

What is needed is a guitar tuning device that locks the tuning of a guitar with a flip tuning levers device that do not put added stress on the guitar strings to get them out of tune.

SUMMARY OF THE INVENTION

The present invention is a tuning device for a guitar. More specifically, the present invention is a plurality of flip tuning levers. The flip tuning levers device includes a plurality of levers depressed to close the flip tuning levers device, a vertical shaft extending downward from each of the levers, the vertical shafts include an aperture disposed near a distal end of each of the vertical shafts, a plurality of shims each having an aligned hole disposed on each of the shims that each of the vertical shafts are inserted through, each of the shims along each of the vertical shafts are positioned between each of the levers and each of the apertures disposed near the distal ends of each of the vertical shafts, the shims include a first shim, a second shim, and a third shim, a horizontal shaft having an elongated horizontal shaft portion and a perpendicular distal end, the horizontal shaft is inserted through each of the apertures disposed near a distal end of each of the vertical shafts, the horizontal shaft is withdrawn from each of the apertures disposed near the distal end of each of the vertical shafts when the flip tuning levers device is broken down and removed off from the strings and the headstock of the guitar, and a base plate having a plurality of apertures and a plurality of raised corresponding grooves, the apertures include a first set of apertures that accommodate receiving a plurality of fasteners and a second set of apertures that accommodate receiving the distal ends of each of the vertical shafts, the first set of apertures correspond with a plurality of preexisting holes disposed on the headstock of the guitar.

It is an object of the present invention to provide a flip tuning levers device that allows a user to tune a guitar without a hex wrench. It is an object of the present invention to provide a flip tuning levers device that will not strip like a plurality of screws from a screw-related device that locks the tuning of a guitar. It is an object of the present invention to provide a flip tuning levers device that may be retrofit to a current guitar. It is an object of the present invention to provide a flip tuning levers device that accommodates for guitar string thickness. It is an object of the present invention to provide a flip tuning levers device that is made of titanium for strength and being lightweight and easy to fabricate. It is an object of the present invention to provide a flip tuning levers device that is made with a three dimensional printer for accuracy and cost-reduction.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
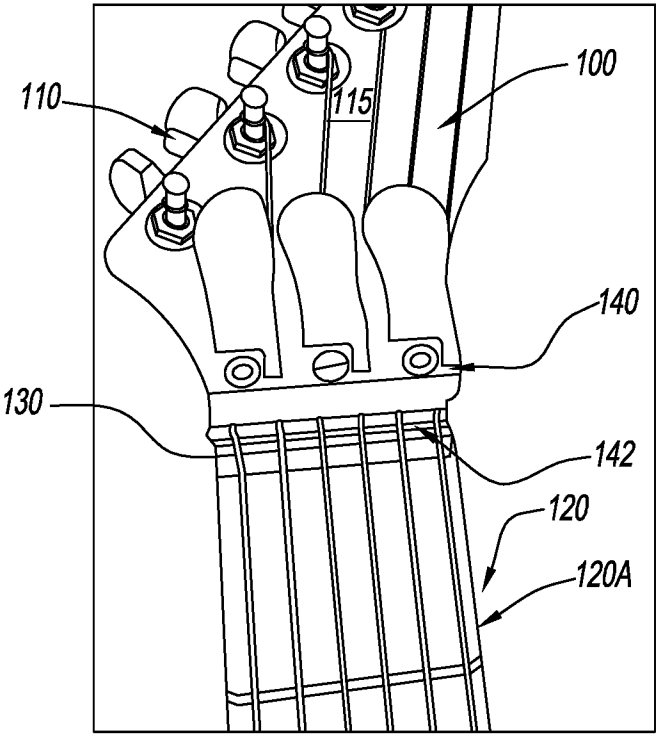
FIG. 1 illustrates an environmental overhead view of a flip tuning levers device, in accordance with one embodiment of the present invention.

FIG. 1 illustrates an environmental overhead view of a flip tuning levers device 100, in accordance with one embodiment of the present invention.

The flip tuning levers device 100 may be adapted to be positioned over a plurality of strings 110 of a guitar 120 or the like. More specifically, the flip tuning levers device 100 may be adapted to be positioned over the strings 110 onto a neck 130 of the guitar 120 in front of a nut 140 of the guitar 120 or the like. The nut 140 may include a plurality of grooves 142 that receives each of the strings 110 and holds each of the strings 110 from the guitar 120. FIG. 1 illustrates the guitar 120 having 6 strings 110 that correspond to and receive 6 grooves 142 disposed on the nut 140 from a 6-string guitar 120A or the like. The flip tuning levers device 100 may be adapted to be positioned over a bass or 4 string guitar (not shown) or another stringed instrument as well.

Figure 2:
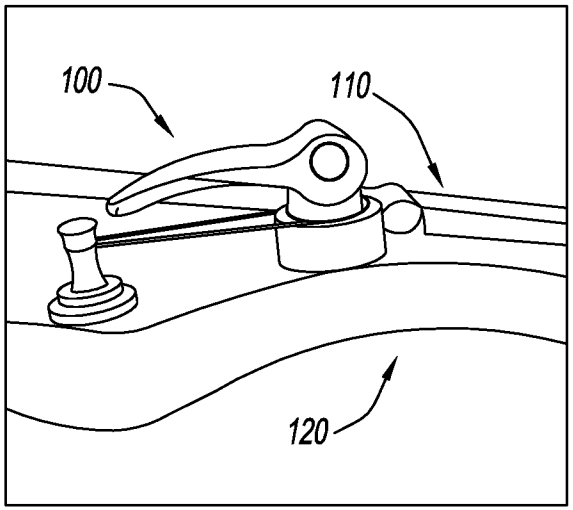
FIG. 2 illustrates an environmental side perspective view of a flip tuning levers device, in accordance with one embodiment of the present invention.

FIG. 2 illustrates an environmental side perspective view of a flip tuning levers device 100, in accordance with one embodiment of the present invention.

The flip tuning levers device 100 illustrated in FIG. 2 is in a closed or locked position to lock the strings 110 of the guitar 120 in place.

Figure 3:
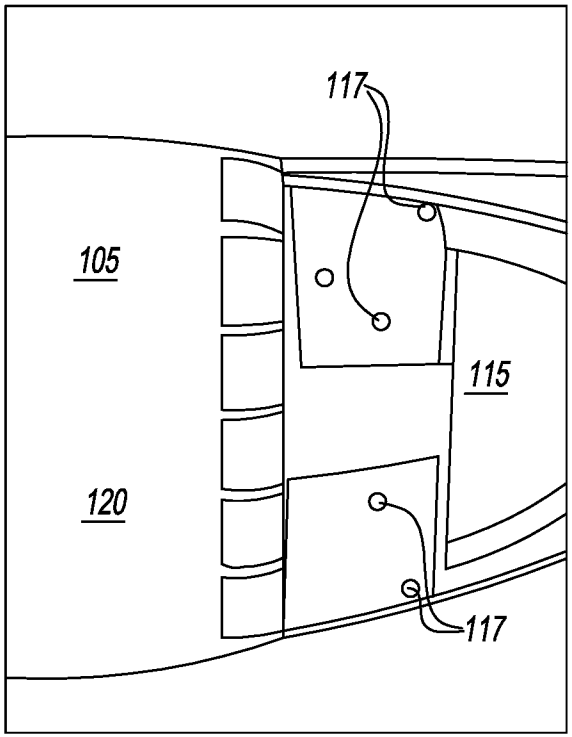
FIG. 3 illustrates an environmental overhead view of a guitar neck and a headstock being prepared to install a flip tuning levers device onto, in accordance with one embodiment of the present invention.

FIG. 3 illustrates an environmental overhead view of a guitar neck 105 and a headstock 115 of a guitar 120 being prepared to install a flip tuning levers device (FIG. 1, 100) onto, in accordance with one embodiment of the present invention.

The headstock 115 of the guitar 120 may include a plurality of predrilled holes 117 disposed on the headstock 115 of the guitar 120. The predrilled holes 117 may already exist on the headstock 115 of the guitar 120 that are disposed on the headstock 115 of the guitar 120 or the like.

Figure 4:
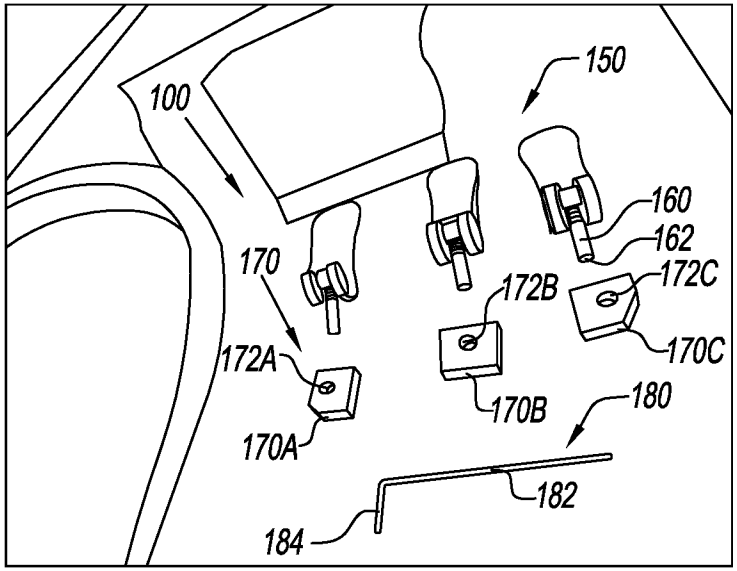
FIG. 4 illustrates an exploded overhead perspective view of a flip tuning levers device, in accordance with one embodiment of the present invention.

FIG. 4 illustrates an exploded overhead perspective view of a flip tuning levers device 100, in accordance with one embodiment of the present invention.

The flip tuning levers device 100 may include a plurality of levers 150, a plurality of vertical shafts 160, a plurality of shims 170, and a horizontal shaft 180.

The levers 150 may all be depressed to close the flip tuning levers device 100, which close or lock the strings 110 of the guitar 120 in place against the neck 130 of the guitar 120 in front of the nut (FIG. 1, 140) of the guitar 120 or the like. The vertical shafts 160 may each extend downward from each of the levers 150. The vertical shafts 160 may each include an aperture 162 disposed near a distal end of each of the vertical shafts 160. The shims 170 may include a hole 172 disposed on each of the shims 170 that each of the vertical shafts 160 are inserted through. Each of the shims 170 along each of the vertical shafts 160 may be positioned between each of the levers 150 and each of the apertures 162 disposed near the distal ends of each of the vertical shafts 160. The shims 170 may include a first shim 170A, a second shim 170B, and a third shim 170C. The horizontal shaft 180 may include an elongated horizontal shaft portion 182 and a perpendicular distal end 184. The elongated horizontal shaft portion 182 may have a round cross-sectional shape, a square cross-sectional shape, a hexagonal cross-sectional shape, or the like. The horizontal shaft 180 may be inserted through each of the apertures 162 disposed near a distal end of each of the vertical shafts 160 when the flip tuning levers device 100 is assembled. FIG. 4 illustrates 3 levers 150, 3 vertical shafts 160, and 3 shims.

Figure 5:
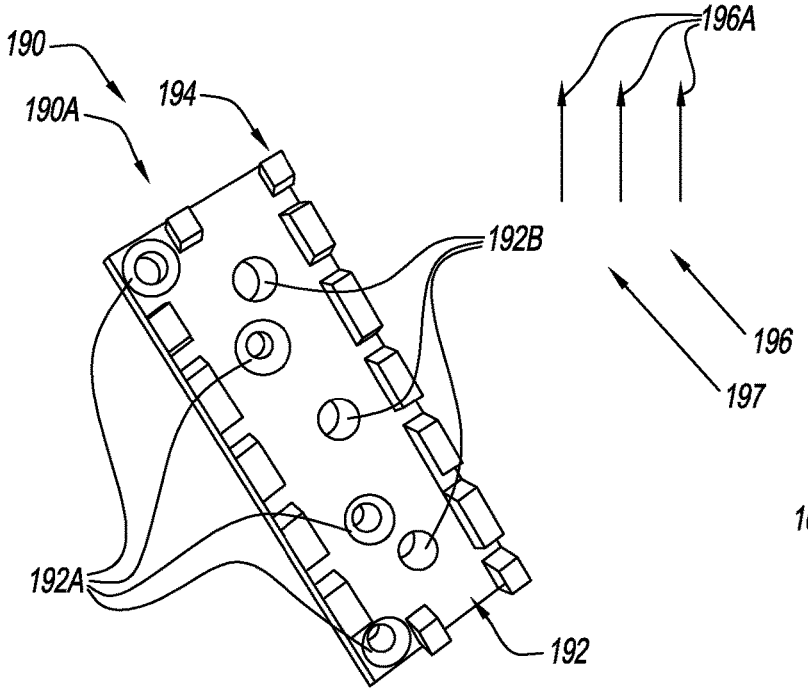
FIG. 5 illustrates an overhead perspective view of a base plate of a flip tuning levers device, in accordance with one embodiment of the present invention.

FIG. 5 illustrates an overhead perspective view of a base plate 190 of a flip tuning levers device 100, in accordance with one embodiment of the present invention.

The base plate 190 may have a generally planar rectangular shape 190A or the like. The base 190 may include a plurality of apertures 192 and a plurality of raised corresponding grooves 194. The apertures 192 may include a first set of apertures 192A that may accommodate receiving a plurality of fasteners 196 and a second set of apertures 192B that may accommodate receiving the distal ends of each of the vertical shafts 160. The first set of apertures 192A may correspond to a plurality of predrilled holes (FIG. 3, 117) disposed on the headstock (FIG. 3, 115) of the guitar 120. The fasteners 196 may be inserted through the first set of apertures 192A and the predrilled holes (FIG. 3, 117) to couple the flip tuning levers device 100 to the headstock (FIG. 3, 115) of the guitar 120. The first set of apertures 192A may also be widened on the base plate 190 to accommodate the fasteners 196 and a plurality of wide fastener heads 196A found on a wood screw fastener 197 and the like. The second set of apertures 192B may accommodate each of the distal ends of each of the vertical shafts (FIG. 4, 160).

Figure 6:
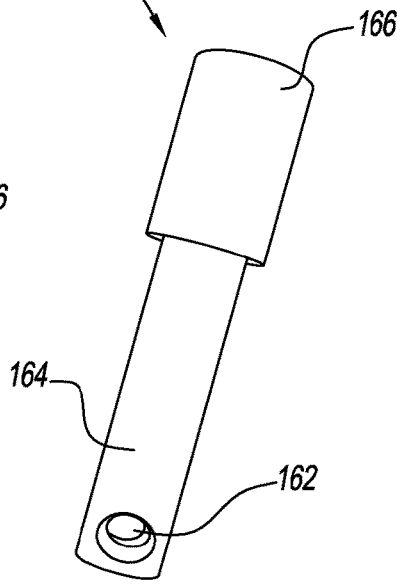
FIG. 6 illustrates a side perspective view of a vertical shaft of a flip tuning levers device, in accordance with one embodiment of the present invention.

FIG. 6 illustrates a side perspective view of a vertical shaft 160 of a flip tuning levers device 100, in accordance with one embodiment of the present invention.

Each of the vertical shafts 160 may include the aperture 162 disposed near a distal end of each of the vertical shafts 160, an elongated stem portion 164, and a top cap portion 166.

Figure 7:
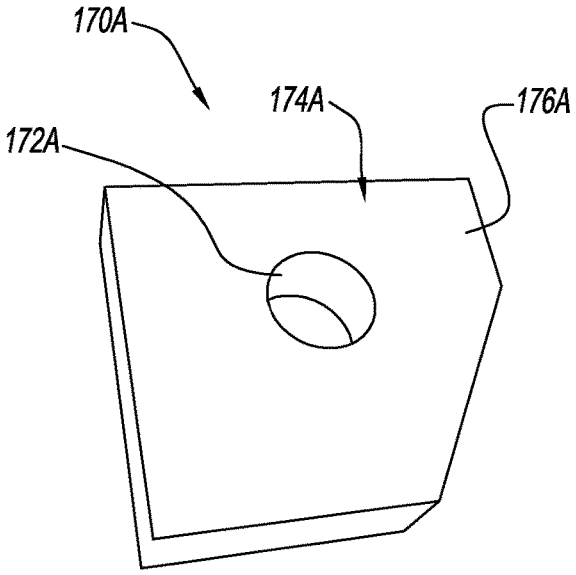
FIG. 7 illustrates an overhead perspective view of a first shim of a flip tuning levers device, in accordance with one embodiment of the present invention.

FIG. 7 illustrates an overhead perspective view of a first shim 170A of a flip tuning levers device 100, in accordance with one embodiment of the present invention.

The first shim 170A may include a hole 172A, a generally planar square-shaped base 174A, and a truncated corner 176A. The first shim 170A may be placed along an outer most one of the vertical shafts 160 and the truncated corner 176A prevents any portion of the generally planar square-shaped base 174A from extending outward and being contacted by any objects or the like.

Figure 8:
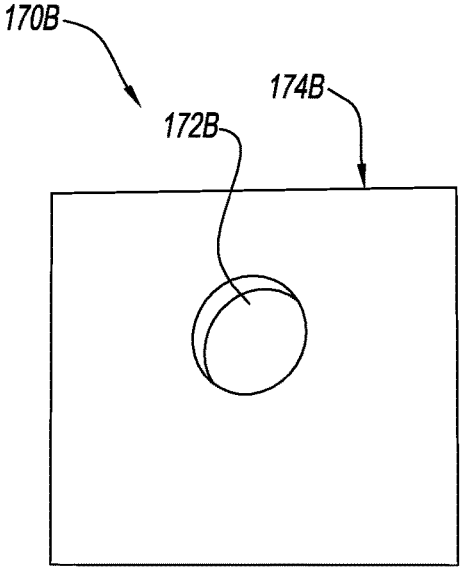
FIG. 8 illustrates an overhead perspective view of a second shim of a flip tuning levers device, in accordance with one embodiment of the present invention.

FIG. 8 illustrates an overhead perspective view of a second shim 170B of a flip tuning levers device 100, in accordance with one embodiment of the present invention.

The second shim 170B may include a hole 172B and a generally planar square-shaped base 174B.

Figure 9:
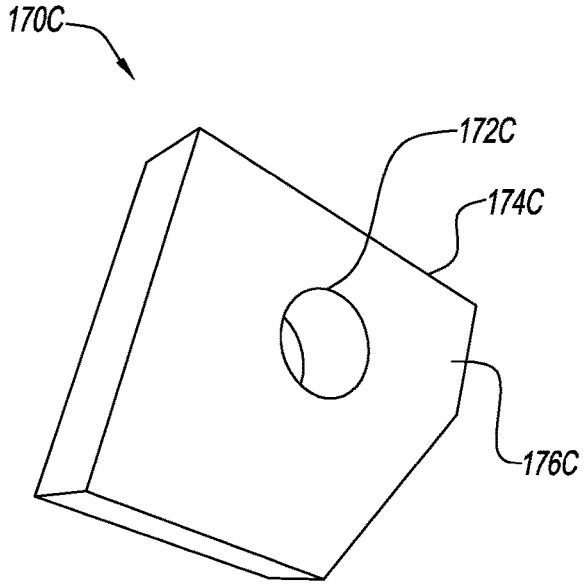
FIG. 9 illustrates an overhead perspective view of a third shim of a flip tuning levers device, in accordance with one embodiment of the present invention.

FIG. 9 illustrates an overhead perspective view of a third shim 170C of a flip tuning levers device 100, in accordance with one embodiment of the present invention.

The third shim 170C may include a hole 172C, a generally planar square-shaped base 174C, and a truncated corner 176C. The third shim 170C may be placed along an outer most one of the vertical shafts 160 and the truncated corner 176C prevents any portion of the generally planar square-shaped base 174C from extending outward and being contacted by any objects or the like.

Figure 10:
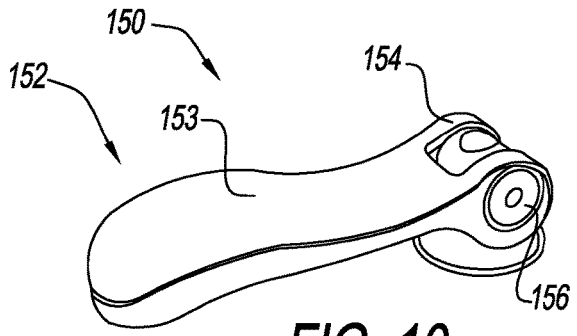
FIG. 10 illustrates a side perspective view of a lever of a flip tuning levers device, in accordance with one embodiment of the present invention.

FIG. 10 illustrates an overhead perspective view of a lever 150 of a flip tuning levers device 100, in accordance with one embodiment of the present invention.

The lever 150 may include a handle 152, a rotating pin joint 154, and an upside-down cylindrical-shaped indentation 156. The handle 152 may be ergonomically designed to facilitate depressing the handle 152. More specifically, the handle 152 may include a raised elongated middle portion 153 to facilitate depressing the handle 152 without strain and improve tactile feel of depressing the handle 152. The rotating pin joint 154 may be inserted into a fitted aperture disposed on an end of the handle 152 to allow for smoothly moving the handle 152 forward and moving the handle backward. The upside-down cylindrical-shaped indentation 156 may receive and couple to the top cap portion (FIG. 6, 166) of the vertical shaft 160. The upside-down cylindrical-shaped indentation 156 may move the top cap portion 166 and the vertical shaft 160 up and down as the handle 152 is moved forward and backward, thereby closing and opening the flip tuning levers device 100 against the headstock (FIG. 1, 115) of the guitar (FIG. 1, 120).

Figure 11:
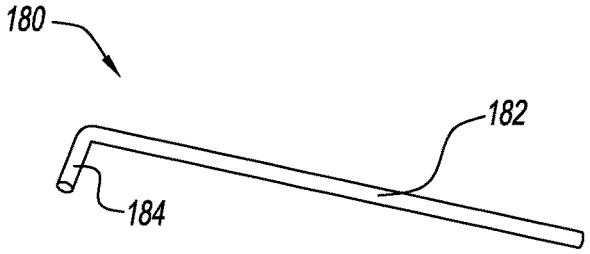
FIG. 11 illustrates a side perspective view of a horizontal shaft of a flip tuning levers device, in accordance with one embodiment of the present invention.

FIG. 11 illustrates an overhead perspective view of a horizontal shaft 180 of a flip tuning levers device 100, in accordance with one embodiment of the present invention.

The horizontal shaft 180 may be withdrawn from each of the apertures (FIG. 6, 162) disposed near the distal end of each of the vertical shafts (FIG. 6, 160) when the flip tuning levers device 100 is broken down and removed off from the strings (FIG. 1, 110) and headstock (FIG. 1, 115) of the guitar (FIG. 1, 120).

Figure 12:
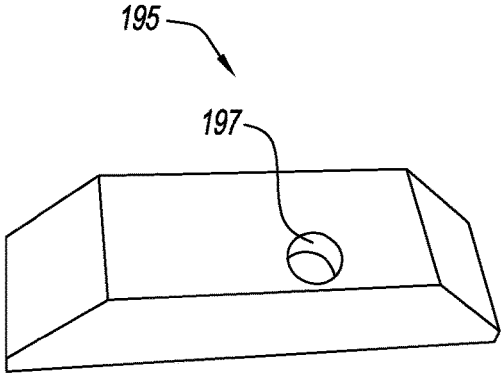
FIG. 12 illustrates an overhead perspective view of a handle of a horizontal shaft of a flip tuning levers device, in accordance with one embodiment of the present invention.

FIG. 12 illustrates an overhead perspective view of a handle 195 of a horizontal shaft (FIG. 11, 180) from a flip tuning levers device 100, in accordance with one embodiment of the present invention.

The handle 195 may be disposed on an end of the perpendicular distal end (FIG. 11, 184) of the horizontal shaft (FIG. 11, 180). The handle 195 may include an aperture 197 disposed on the handle 195 that may receive the perpendicular distal end (FIG. 11, 184) of the horizontal shaft (FIG. 11, 180) to facilitate grasping and removal of the horizontal shaft 180.

The flip tuning levers device 100 and its components may be made of a material selected from the group consisting of plastic, stainless steel, steel, or metal or the like. The flip tuning levers device 100 and its components may also be made of titanium for strength and being lightweight and easy to fabricate. The flip tuning levers device 100 and its components may also be made from a three dimensional printer for accuracy and cost-reduction.

Use of the flip tuning levers is straightforward. The flip tuning levers flip-up for guitar tuning and simply flip-down to lock the guitar tuning. There is a pin that goes through the bottom of the flip tuning levers for extra security. When the pin is removed the flip tuning levers will release and the strings can be changed. This is the only circumstance that you need to remove the pin and the flip tuning levers. There is also a plurality of shims that will keep the flip tuning levers more secure that are also removable.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A flip tuning levers device, comprising:

a plurality of levers depressed to close the flip tuning levers device;

a vertical shaft extending downward from each of the levers, the vertical shafts include an aperture disposed near a distal end of each of the vertical shafts;

a plurality of shims each having an aligned hole disposed on each of the shims that each of the vertical shafts are inserted through, each of the shims along each of the vertical shafts are positioned between each of the levers and each of the apertures disposed near the distal ends of each of the vertical shafts, the shims include a first shim, a second shim, and a third shim;

a horizontal shaft having an elongated horizontal shaft portion and a perpendicular distal end, the horizontal shaft is inserted through each of the apertures disposed near a distal end of each of the vertical shafts, the horizontal shaft is withdrawn from each of the apertures disposed near the distal end of each of the vertical shafts when the flip tuning levers device is broken down and removed off from the strings and a headstock of the guitar; and a base plate having a plurality of apertures and a plurality of raised corresponding grooves, the apertures include a first set of apertures that accommodate receiving a plurality of fasteners and a second set of apertures that accommodate receiving the distal ends of each of the vertical shafts, the first set of apertures correspond with a plurality of preexisting holes disposed on the headstock of the guitar.

2. The flip tuning levers device, according to claim 1, wherein the first shim includes a hole, a generally planar square-shaped base, and a truncated corner.

3. The flip tuning levers device, according to claim 1, wherein the levers are depressed to close the flip tuning levers device and are adapted to close or lock the strings of the guitar in place against the neck of the guitar in front of the nut of the guitar.

4. The flip tuning levers device, according to claim 1, wherein the levers each include a handle, a rotating pin joint, and an upside-down cylindrical-shaped indentation.

5. The flip tuning levers device, according to claim 4, wherein the handle is ergonomically designed and includes a raised elongated middle portion to facilitate depressing the handle without strain and improve tactile feel of depressing the handle.

6. The flip tuning levers device, according to claim 4, wherein the rotating pin joint is inserted into a fitted aperture disposed on an end of the handle to allow for smoothly moving the handle forward and moving the handle backward.

7. The flip tuning levers device, according to claim 4, wherein the upside-down cylindrical-shaped indentation receives and couples to the top cap portion of the vertical shaft.

8. The flip tuning levers device, according to claim 1, wherein the upside-down cylindrical-shaped indentation moves the top cap portion and the vertical shaft up and down as the handle is moved forward and backward, thereby closing and opening the flip tuning levers device against the headstock of the guitar.

9. The flip tuning levers device, according to claim 1, wherein the elongated horizontal shaft portion has a shape selected from the group consisting of a round cross-sectional shape, a square cross-sectional shape, or a hexagonal cross-sectional shape.

10. The flip tuning levers device, according to claim 1, wherein the handle is disposed on an end of the perpendicular distal end of the horizontal shaft to facilitate grasping and removal of the horizontal shaft.

11. The flip tuning levers device, according to claim 1, wherein the handle has a generally trapezoidal shape to facilitate grasping the handle and turning the horizontal shaft.

12. The flip tuning levers device, according to claim 1, wherein the first shim is placed along an outer most one of the vertical shafts and the truncated corner to prevent any portion of the generally planar square-shaped base from extending outward and being made contact with by one or more objects.

13. The flip tuning levers device, according to claim 1, wherein the third shim includes a hole, a generally planar square-shaped base, and a truncated corner.

14. The flip tuning levers device, according to claim 13, wherein the third shim placed along an outer most one of the vertical shafts and the truncated corner that prevents any portion of the generally planar square-shaped base from extending outward and being made contact with one or more objects.

15. The flip tuning levers device, according to claim 1, wherein the base plate has a generally planar rectangular shape.

16. The flip tuning levers device, according to claim 1, wherein the first set of apertures are widened on the base plate to accommodate the fasteners and a plurality of wide fastener heads.

17. The flip tuning levers device, according to claim 16, wherein the fasteners are a plurality of wood screws each with a relatively wide fastener head.

18. The flip tuning levers device, according to claim 1, wherein the flip tuning levers device is made of titanium for strength and ease of fabrication.

19. The flip tuning levers device, according to claim 1, wherein the flip tuning levers device is made from a three-dimensional printer for accuracy and cost-reduction.

20. The flip tuning levers device, according to claim 1, wherein the flip tuning levers device is made of a material selected from the group consisting of plastic, stainless steel, steel, or metal.

* * * * *